US011609031B2

(12) United States Patent
Matsuda et al.

(10) Patent No.: US 11,609,031 B2
(45) Date of Patent: Mar. 21, 2023

(54) REFRIGERATION CYCLE APPARATUS

(71) Applicant: Mitsubishi Electric Corporation, Tokyo (JP)

(72) Inventors: Takuya Matsuda, Tokyo (JP); Makoto Wada, Tokyo (JP); Yuji Motomura, Tokyo (JP); Katsuhiro Ishimura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 143 days.

(21) Appl. No.: 16/485,342

(22) PCT Filed: Mar. 13, 2017

(86) PCT No.: PCT/JP2017/009971
§ 371 (c)(1),
(2) Date: Aug. 12, 2019

(87) PCT Pub. No.: WO2018/167820
PCT Pub. Date: Sep. 20, 2018

(65) Prior Publication Data

US 2020/0011580 A1 Jan. 9, 2020

(51) Int. Cl.
*F25B 41/24* (2021.01)
*F25B 49/02* (2006.01)
*F25B 41/20* (2021.01)

(52) U.S. Cl.
CPC ..... *F25B 41/24* (2021.01); *F25B 41/20* (2021.01); *F25B 49/022* (2013.01); *F25B 2500/222* (2013.01)

(58) Field of Classification Search
CPC .. F25B 49/022; F25B 2500/222; F25B 41/20; F25B 2400/19; F25B 2700/1933;
(Continued)

(56) References Cited

U.S. PATENT DOCUMENTS 5,732,564 A 3/1998 Misawa et al.
2014/0311172 A1* 10/2014 Iwasaki ..... F25B 47/02 62/151

(Continued)

FOREIGN PATENT DOCUMENTS

EP 2 792 971 A1 10/2014
EP 2792971 A1 * 10/2014

(Continued)

OTHER PUBLICATIONS

Morishita et al., Refrigeration and Air Conditioning Device and Refrigeration and Air Conditioning System, Jun. 20, 2013, JP2013122364A, Whole Document (Year: 2013).*

(Continued)

*Primary Examiner* — Larry L Furdge
(74) *Attorney, Agent, or Firm* — Posz Law Group, PLC

(57) ABSTRACT

When a refrigerant leakage sensor detects a leakage of refrigerant from a refrigeration cycle apparatus having an indoor unit and an outdoor unit, a refrigerant recovery operation is started. In the refrigerant recovery operation, refrigerant is recovered in an accumulator and afterward a pump down operation is performed. In recovery of refrigerant in the accumulator, refrigerant in a liquid phase is accumulated in the accumulator as a result of circulation of refrigerant by operating a compressor in the state where a liquid shut-off valve and a gas shut-off valve are opened. After recovery of refrigerant in the accumulator is ended, the refrigerant in a liquid phase is accumulated in an outdoor heat exchanger by the pump down operation for operating the compressor in the state where the liquid shut-off valve is closed.

7 Claims, 12 Drawing Sheets

(58) Field of Classification Search
CPC .. F25B 2700/21151; F25B 2700/21152; F25B 2700/1931; F25B 2313/0314; F25B 2313/0315; F25B 2313/0313; F25B 13/00; F25B 49/02
See application file for complete search history.

(56) References Cited

U.S. PATENT DOCUMENTS

| | | | | |
|---|---|---|---|---|
| 2017/0010030 | A1 * | 1/2017 | Tanaka | F25B 13/00 |
| 2018/0142931 | A1 | 5/2018 | Takagi | |

FOREIGN PATENT DOCUMENTS

| | | | | |
|---|---|---|---|---|
| EP | 3 040 655 | A1 | | 7/2016 |
| JP | S62-077769 | U | | 5/1987 |
| JP | H05-118720 | A | | 5/1993 |
| JP | H06-012972 | A | | 1/1994 |
| JP | H08-049930 | A | | 2/1996 |
| JP | H09138016 | A | * | 5/1997 |
| JP | H11142003 | A | * | 5/1999 |
| JP | 3162132 | B | | 4/2001 |
| JP | 2013-124792 | A | | 6/2013 |
| JP | 2013122364 | A | * | 6/2013 |
| JP | 2015075272 | A | * | 4/2015 |
| JP | 2015-087071 | A | | 5/2015 |
| JP | 2015-105813 | A | | 6/2015 |
| JP | 2017-020776 | A | | 1/2017 |

OTHER PUBLICATIONS

Kanazawa et al., Refrigeration Device, Oct. 22, 2014, EP2792971A1, Whole Document (Year. 2014).*
Aoyama et al., Heat Pump Type Air Conditioner, May 27, 1997, JPH09138016A, Whole Document (Year: 1997).*
Kawai et al., Air Conditioner, Apr. 20, 2015, JP2015075272A, Whole Document (Year: 2015).*
Ueno et al., Refrigerating Device, May 28, 1999, JPH11142003A, Whole Document (Year: 1999).*
Matsunaga et al., Air Conditioner, Apr. 20, 2015, JP2015075272A, Whole Document (Year: 2015).*
International Search Report ("ISR") dated May 23, 2017 issued in corresponding international patent application No. PCT/JP2017/009971.
Office Action dated Sep. 15, 2020 issued in corresponding JP application No. 2019-505318( and English translation).
Extended European Search Report dated Jan. 14, 2020 issued in corresponding EP patent application No. 17900472.6.

* cited by examiner

REFRIGERATION CYCLE APPARATUS

CROSS REFERENCE TO RELATED APPLICATION

This application is a U.S. national stage application of International Application PCT/JP2017/009971, filed on Mar. 13, 2017, the contents of which are incorporated herein by reference.

TECHNICAL FIELD

The present invention relates to a refrigeration cycle apparatus, and particularly to a refrigeration cycle apparatus including an accumulator on the refrigerant suction side relative to a compressor.

BACKGROUND

In a refrigeration cycle apparatus, air conditioning is performed by heat exchange accompanied with liquefaction (condensation) and vaporization (evaporation) of circulating refrigerant that is enclosed therein. Japanese Patent No. 3162132 (PTL 1) discloses a refrigeration apparatus configured to control, based on the result of detection by a refrigerant leakage detection device, two on-off valves provided at some midpoint in a pipe that connects an indoor unit and an outdoor unit in order to provide a circulation path for refrigerant.

Specifically, PTL 1 discloses that, when a leakage of refrigerant is detected, a compressor is operated in the state where one of the on-off valves is closed, that is, the so-called pump down operation is performed. Furthermore, Japanese Patent Laying-Open No. 2013-124792 (PTL 2) discloses that a pump down operation for collecting refrigerant in a unit on the heat source side is controlled in a configuration including an accumulator provided in a pipe on the refrigerant suction side relative to a compressor.

Patent Literature

PTL 1: Japanese Patent No. 3162132

PTL 2: Japanese Patent Laying-Open No. 2013-124792

When refrigerant leaks, some refrigerant cannot be recovered to the indoor unit side by a pump down operation. Such refrigerant may continuously leak through the leakage portion. Accordingly, it is desirable to increase the amount of refrigerant to be recovered in the refrigerant recovery operation performed upon detection of a leakage of refrigerant. In this regard, PTL 1 still has room for improvement in the amount of refrigerant to be recovered upon detection of a leakage of refrigerant. PTL 2 fails to mention refrigerant recovery performed upon detection of a leakage of refrigerant.

SUMMARY

The present invention has been made in order to solve the above-described problems. An object of the present invention is to increase the amount of refrigerant to be recovered in a refrigerant recovery operation performed upon detection of a leakage of refrigerant, in a refrigeration cycle apparatus including an accumulator on the refrigerant suction side relative to a compressor.

In an aspect of the present disclosure, a refrigeration cycle apparatus is equipped with an outdoor unit and at least one indoor unit. The refrigeration cycle apparatus includes: a compressor; an accumulator; an outdoor heat exchanger provided in the outdoor unit; an indoor heat exchanger provided in the indoor unit; an indoor fan provided corresponding to the indoor heat exchanger; a leakage sensor for refrigerant; a circulation path of the refrigerant; a first shut-off valve; an expansion valve; and a controller configured to control an operation of the refrigeration cycle apparatus. The accumulator is provided on a suction side for refrigerant relative to the compressor. The circulation path of the refrigerant is located in the outdoor unit and the indoor unit to include the compressor, the accumulator, the expansion valve, the outdoor heat exchanger, and the indoor heat exchanger. The first shut-off valve is provided in a path that connects the outdoor heat exchanger and the indoor heat exchanger without passing through the compressor in the circulation path. When the leakage sensor detects a leakage of the refrigerant, the controller performs a first refrigerant recovery operation and a second refrigerant recovery operation in a state where the circulation path is formed in a direction in which refrigerant discharged from the compressor passes through the outdoor heat exchanger and the expansion valve, and subsequently passes through the indoor heat exchanger. In the first refrigerant recovery operation, the compressor is operated while the first shut-off valve and the expansion valve are opened. In the second refrigerant recovery operation performed after the first refrigerant recovery operation is ended, the compressor is operated while the first shut-off valve is closed.

According to the above-described refrigeration cycle apparatus, by stepwise execution of: the first refrigerant recovery operation for accumulating refrigerant in a liquid phase in the accumulator in accordance with circulation of refrigerant; and the second refrigerant recovery operation for accumulating refrigerant in a liquid phase in the outdoor heat exchanger after the end of recovery of refrigerant in the accumulator, it becomes possible to increase the amount of refrigerant to be recovered in the refrigerant recovery operation performed upon detection of a leakage of refrigerant.

According to the present invention, in a refrigeration cycle apparatus equipped with an accumulator on the refrigerant suction side relative to a compressor, it becomes possible to increase the amount of refrigerant to be recovered in the refrigerant recovery operation performed upon detection of a leakage of refrigerant.

DETAILED DESCRIPTION

Figure 1:
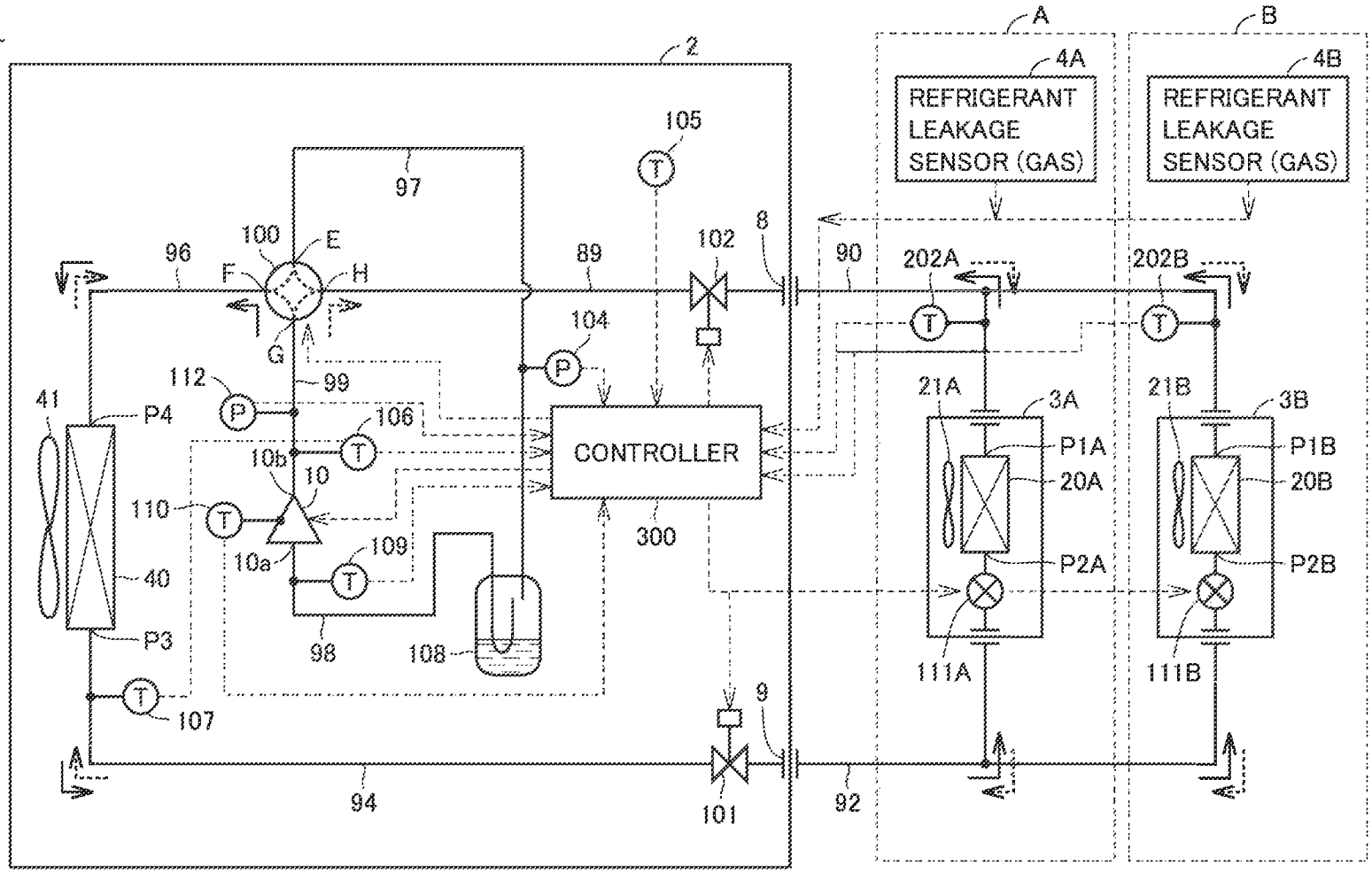
FIG. 1 is a block diagram showing the configuration of a refrigerant circuit in a refrigeration cycle apparatus according to the first embodiment.

The embodiments of the present invention will be hereinafter described in detail with reference to the accompanying drawings, in which the same or corresponding components will be hereinafter designated by the same reference characters, and the description thereof will not be basically repeated.

First Embodiment (Apparatus Configuration)

FIG. 1 is a block diagram showing the configuration of a refrigerant circuit in a refrigeration cycle apparatus 1*a* according to the first embodiment.

Referring to FIG. 1, refrigeration cycle apparatus 1*a* includes an outdoor unit 2 and at least one indoor unit 3. FIG. 1 shows an example illustrating an example configuration in which indoor units 3A and 3B are provided corresponding to two rooms A and B, respectively. However, the number of indoor units 3 may be one, or may be three or more.

In rooms A and B, refrigerant leakage sensors 4A and 4B are disposed corresponding to indoor units 3A and 3B, respectively. Each of refrigerant leakage sensors 4A and 4B is configured to detect the gas concentration of the refrigerant (which will be hereinafter also referred to as a "refrigerant gas concentration") contained in the atmosphere and used in refrigeration cycle apparatus 1*a*. Alternatively, each of refrigerant leakage sensors 4A and 4B can also be configured to detect the oxygen concentration in order to detect a decrease in oxygen concentration caused by an increase in refrigerant gas concentration. Each of refrigerant leakage sensors 4A and 4B corresponds to a "leakage sensor" for refrigerant.

In the following explanation, the elements provided in each of rooms A and B (indoor units 3A and 3B) are denoted by reference numerals with no suffix when the description is common to the rooms; whereas the elements are denoted by reference numerals with suffixes A and B when the rooms are distinguished from each other. For example, each of refrigerant leakage sensors 4A and 4B is also denoted simply as a refrigerant leakage sensor 4 in the description of the feature common to refrigerant leakage sensors 4A and 4B. The refrigerant leakage sensor may be further provided on the outdoor unit 2 side, and the installation position thereof is not limited.

In refrigeration cycle apparatus 1*a*, outdoor unit 2 includes a compressor 10, an outdoor heat exchanger 40, an outdoor fan 41, a four-way valve 100, shut-off valves 101, 102, pipes 89, 94, 96 to 99, and an accumulator 108. Four-way valve 100 has ports E, F, G, and H. Outdoor heat exchanger 40 has ports P3 and P4.

Indoor unit 3A includes an indoor heat exchanger 20A, an indoor fan 21A, and a linear electronic expansion valve (LEV) 111A. Similarly, indoor unit 3B includes an indoor heat exchanger 20B, an indoor fan 21B, and an LEV 111B. Indoor heat exchanger 20A has ports HA and P2A. Indoor heat exchanger 20B has ports P1B and P2B.

Refrigeration cycle apparatus 1*a* further includes a controller 300. Controller 300 includes a central processing unit (CPU), a storage device, an input/output buffer (each of which is not shown), and the like. Controller 300 controls the operations of outdoor unit 2 and indoor unit 3 (3A, 3B) so as to cause refrigeration cycle apparatus 1*a* to be operated according to the operation command from a user. Furthermore, controller 300 receives a detection value from each refrigerant leakage sensor 4.

The operation command to refrigeration cycle apparatus 1*a* is input by a remote controller (not shown), for example. The operation command can include: a command to start/stop refrigeration cycle apparatus 1*a*; a command to set a timer operation; a command to select an operation mode; a command to set a set temperature;

and the like. The remote controller can be provided in the vicinity of outdoor unit 2 or indoor unit 3, and in an operation monitor room of refrigeration cycle apparatus 1*a*.

In the description of the example in FIG. 1, controller 300 within outdoor unit 2 comprehensively has control functions related to refrigeration cycle apparatus 1*a*. However, these control functions may be distributed in outdoor unit 2 and each indoor unit 3.

Then, the configurations of outdoor unit 2 and indoor unit 3 will be described in greater detail.

Compressor 10 is configured to be capable of changing the operation frequency by a control signal from controller 300. By changing the operation frequency of compressor 10, the output of the compressor is adjusted. Compressor 10 may be of various types such as a rotary type, a reciprocating type, a scroll type, and a screw type, for example.

Accumulator 108 is connected to a refrigerant inlet 10*a* of compressor 10 through a pipe 98. In accumulator 108, the refrigerant supplied through four-way valve 100 is subjected to gas-liquid separation.

Pipe 89 connects port H of four-way valve 100 to a gas-side refrigerant pipe connecting port 8 of the outdoor unit. Pipe 89 has a shut-off valve 102 (a gas shut-off valve). To gas-side refrigerant pipe connecting port 8, one end of an extension pipe 90 is connected outside the outdoor unit. The other end of extension pipe 90 is connected to one port of indoor heat exchanger 20 in each indoor unit 3. In the example in FIG. 1, one end of extension pipe 90 is connected to ports P1A and P1B.

Pipe 94 connects a liquid-side refrigerant pipe connecting port 9 of the outdoor unit and port P3 of outdoor heat exchanger 40. Pipe 96 connects port P4 of outdoor heat exchanger 40 and port F of four-way valve 100. Pipe 94 has shut-off valve 101 (a liquid shut-off valve).

Compressor 10 has a refrigerant outlet 10*b* connected to port G of four-way valve 100. Pipe 98 connects refrigerant inlet 10*a* of compressor 10 and the refrigerant outlet of accumulator 108. Pipe 97 connects the refrigerant inlet of accumulator 108 and port E of four-way valve 100. Pipe 99 connects refrigerant outlet 10*b* of compressor 10 and port G of four-way valve 100.

In this way, four-way valve 100 has: port H connected to the path leading to indoor heat exchanger 20 (20A, 20B); port F connected to the path leading to outdoor heat exchanger 40; and port E connected to the path leading to accumulator 108. In other words, four-way valve 100 has: port E corresponding to the "first port"; port F corresponding to the "second port"; port G corresponding to the "third port"; and port H corresponding to the "fourth port".

Compressor 10 includes a temperature sensor 110 for measuring the shell temperature. Also, at some midpoint of pipe 99, a temperature sensor 106 and a pressure sensor 112 are disposed for measuring a refrigerant temperature TH and a refrigerant pressure PH, respectively, on the discharge side (high-pressure side) relative to compressor 10. Pipe 98 is provided with a temperature sensor 109 for measuring a refrigerant temperature TL at refrigerant inlet 10*a* of compressor 10.

Outdoor unit 2 further includes a pressure sensor 104 and a temperature sensor 107. Temperature sensor 107 is provided in pipe 94 to detect the refrigerant temperature on the liquid side (port P3) of outdoor heat exchanger 40. Pressure sensor 104 is provided to detect a refrigerant pressure PL on the suction side (low-pressure side) of compressor 10. The detection values from pressure sensors 104, 112 and temperature sensors 106, 107, 109 and 110 are sent to controller 300.

Inside indoor unit 3, indoor heat exchanger 20 is connected to LEV 111. In the example in FIG. 1, indoor heat exchanger 20A is connected to LEV 111A inside indoor unit 3A while indoor heat exchanger 20B is connected to LEV 111B inside indoor unit 3B.

In indoor unit 3 (3A, 3B), according to the control signal from controller 300, the degree of opening of LEV 111 (111A, 111B) is controlled to be: fully opened; SH (superheat: degree of superheat)-controlled; SC (subcool: degree of supercool)-controlled; or closed.

On the indoor unit 3 side, a temperature sensor 202 is disposed for detecting a refrigerant temperature on the gas side (the side on which ports P1A and P1B are disposed) relative to indoor heat exchanger 20. In the example in FIG. 1, temperature sensors 202A and 202B are disposed corresponding to indoor heat exchangers 20A and 20B, respectively. The detection value from temperature sensor 202 (202A, 202B) is sent to controller 300.

Four-way valve 100 is controlled by the control signal from controller 300 to bring about a state 1 (cooling operation state) and a state 2 (heating operation state). In state 1, four-way valve 100 is controlled to allow communication between port E and port H and to allow communication between port F and port G.

Thus, compressor 10 is operated in state 1 (the cooling operation state) to thereby form a circulation path of refrigerant in the direction indicated by solid line arrows in FIG. 1. Specifically, the refrigerant that has been changed into high-temperature, high-pressure vapor by compressor 10 flows from refrigerant outlet 10*b* through pipes 99 and 96 and outdoor heat exchanger 40, and then, radiates heat in outdoor heat exchanger 40, so that the refrigerant is condensed (liquefied). Then, the refrigerant passes through pipe 94, extension pipe 92, LEV 111, and indoor heat exchanger 20, and then, absorbs heat in indoor heat exchanger 20, so that the refrigerant is evaporated (vaporized). Furthermore, the refrigerant is returned through extension pipe 90, pipes 89, 97 and accumulator 108 to refrigerant inlet 10*a* of compressor 10. Thereby, the space in which indoor unit 3 is disposed (for example, rooms A and B in which indoor units 3A and 3B, respectively, are disposed) is cooled.

On the other hand, in state 2 (the heating operation state), four-way valve 100 is controlled to allow communication between port G and port H and to allow communication between port E and port F. Compressor 10 is operated in state 2 to thereby form a circulation path of refrigerant in the direction indicated by broken line arrows in the figure. Specifically, the refrigerant that has been changed into high-temperature, high-pressure vapor by compressor 10 flows from refrigerant outlet 10*b* through pipes 99, 89, extension pipe 90 and indoor heat exchanger 20, and then, radiates heat in indoor heat exchanger 20, so that the refrigerant is condensed (liquefied). Then, the refrigerant passes through LEV 111, extension pipe 92, pipe 94, and outdoor heat exchanger 40, and then, absorbs heat in outdoor heat exchanger 40, so that the refrigerant is evaporated (vaporized). Furthermore, the refrigerant is returned through pipes 96, 97 and accumulator 108 to refrigerant inlet 10*a* of compressor 10. Thereby, the space (rooms A and B) in which indoor unit 3 (3A and 3B) is disposed is heated.

In each of state 1 and state 2, pipe 94, which has shut-off valve 101 for shutting off the refrigerant in a liquid state (hereinafter also referred to as a "liquid shut-off valve 101"), is provided in the path that connects outdoor heat exchanger 40 and indoor heat exchanger 20 without passing through compressor 10 in the circulation path of refrigerant. That is, shut-off valve 101 corresponds to one example of the "first shut-off valve". Shut-off valve 101 can also function as a liquid shut-off valve even when it is disposed in extension pipe 92.

On the other hand, in each of state 1 and state 2, pipe 89, which has shut-off valve 102 for shutting off the refrigerant in a gaseous state (hereinafter also referred to as a "gas shut-off valve 102"), is provided in the path that connects outdoor heat exchanger 40 and indoor heat exchanger 20 through compressor 10 in the circulation path of refrigerant. That is, shut-off valve 102 corresponds to one example of the "second shut-off valve". Shut-off valve 102 can also function as a gas shut-off valve even when it is disposed in extension pipe 90.

In the example in FIG. 1, each of shut-off valves 101 and 102 is controlled by controller 300 so as to be opened and closed. For example, shut-off valves 101, 102 can be solenoid valves that are controlled to be opened and closed through electric conduction/non-conduction in an exciting circuit according to a control signal from controller 300. In particular, in the case where the solenoid valve is of a type that is opened during conduction and that is closed during non-conduction, interruption of power supply can close shut-off valves 101 and 102, thereby interrupting the refrigerant.

(Refrigerant Recovery Operation upon Detection of Leakage of Refrigerant)

The following is an explanation about the refrigerant recovery operation performed upon detection of a leakage of refrigerant by refrigerant leakage sensor 4 in refrigeration cycle apparatus 1*a*.

Figure 2:
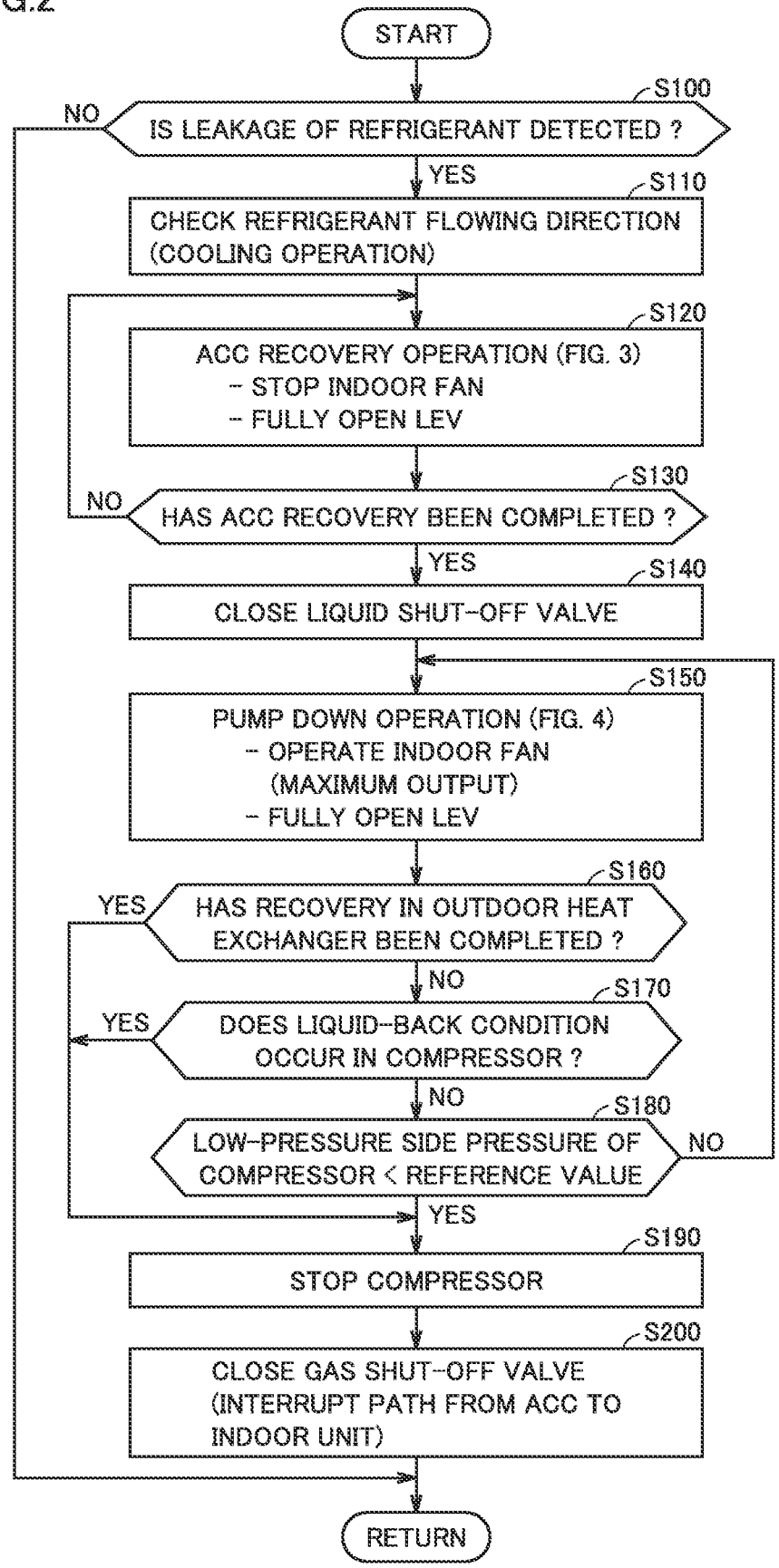
FIG. 2 is a flowchart illustrating a control process in a refrigerant recovery operation in the refrigeration cycle apparatus according to the first embodiment.

FIG. 2 is a flowchart illustrating a control process of a pump down operation for recovering refrigerant in refrigeration cycle apparatus 1*a* according to the first embodiment. The control process shown in FIG. 2 can be performed by controller 300.

Referring to FIG. 2, in step S100, controller 300 detects whether refrigerant leaks or not based on the detection value from refrigerant leakage sensor 4. When a leakage of refrigerant is detected (YES in S100), the process subsequent to step S110 is started in response to this detection as a trigger. On the other hand, when a leakage of refrigerant is not detected (NO in S100), the process subsequent to step S110 is not started. Thus, controller 300 can perform the control process shown in FIG. 2 so as to be started upon detection of a leakage of refrigerant.

In step S110, based on the state of four-way valve 100, controller 300 checks the refrigerant flowing direction in refrigeration cycle apparatus 1*a* as to whether refrigeration cycle apparatus 1*a* is in the refrigerant operation state or not. When four-way valve 100 is controlled to bring about state 2 (heating operation state), controller 300 controls four-way valve 100 to bring about state 1 (cooling operation state).

In step S120, controller 300 performs an operation for recovering refrigerant by the accumulator for accumulating the refrigerant in a liquid state in accumulator 108 (which will be hereinafter also referred to as an "ACC recovery operation"). The ACC recovery operation corresponds to one example of the "first refrigerant recovery operation".

In step S120, controller 300 maintains shut-off valves 101 and 102 to be opened and causes compressor 10 to operate. In the ACC recovery operation, controller 300 stops indoor fan 21 and also causes LEV 111 to be opened (preferably fully opened).

Figure 3:
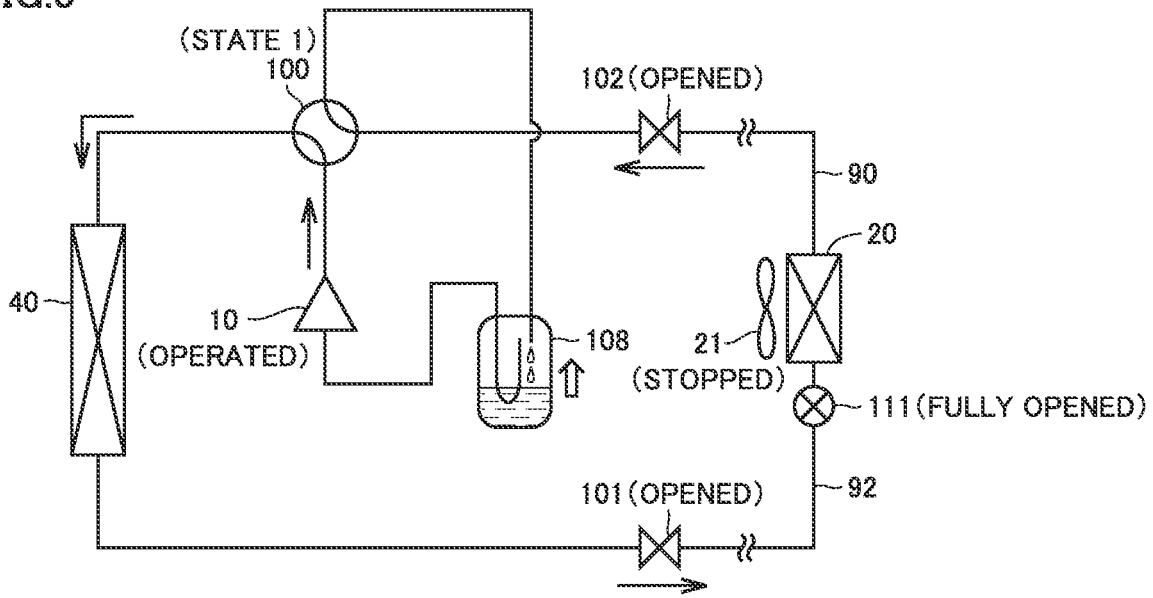
FIG. 3 is a schematic diagram for illustrating the circulation of refrigerant in the refrigeration cycle apparatus in an ACC recovery operation.

FIG. 3 is a schematic diagram for illustrating the circulation of refrigerant in the refrigeration cycle apparatus in the ACC recovery operation.

Referring to FIG. 3, in the ACC recovery operation, in the state where the refrigerant path is formed in the refrigerant operation state, the refrigerant having passed through indoor heat exchanger 20 is returned through accumulator 108 to refrigerant inlet 10*a* of compressor 10. In this case, the refrigerant passing through accumulator 108 is subjected to gas-liquid separation, so that the refrigerant in a liquid phase can be accumulated in accumulator 108.

Furthermore, in order to increase the amount of refrigerant accumulated in accumulator 108, it is preferable to promote moisturization at the outlet of indoor heat exchanger 20 serving as an evaporator. Thus, in the ACC recovery operation, indoor fan 21 is stopped in order to suppress evaporation (vaporization) of the refrigerant in indoor heat exchanger 20. Also, when LEV 111 is fully opened to suppress decompression, vaporization of the refrigerant in indoor heat exchanger 20 can be further suppressed.

Again referring to FIG. 2, during execution of the ACC recovery operation (S120), controller 300 determines in step S130 whether recovery of refrigerant by accumulator 108 has been completed or not (which will be hereinafter also referred to as an "ACC recovery completion determination").

For example, the ACC recovery completion determination can be made based on the detection result from a liquid level sensor (not shown) disposed inside accumulator 108. The liquid level sensor can be disposed at the liquid level position corresponding to the upper limit amount of accumulation in accumulator 108. In other words, when it is detected based on the output from the liquid level sensor that the refrigerant has reached the liquid level position, it can be determined as YES in step S130.

Alternatively, the determination in step S130 can be made based on the refrigerant temperature and the refrigerant pressure on the suction side (the refrigerant inlet 10*a* side) relative to compressor 10 and/or based on the refrigerant temperature and the refrigerant pressure on the discharge side (the refrigerant outlet 10*b* side) relative to compressor 10.

Specifically, on the refrigerant inlet 10*a* side, when a temperature difference (TL−Ts1) between a saturation temperature Ts1 of the refrigerant at the low-pressure side pressure detected by pressure sensor 104 and a refrigerant temperature TL detected by temperature sensor 109 becomes lower than a prescribed reference value T1[K] (when TL−Ts1<T1), that is, when the degree of superheat (SH) on the compressor suction side becomes lower than reference value T1, it is detected that the amount of refrigerant (in a liquid phase) accumulated in accumulator 108 has reached the reference level. Thus, it can be determined as YES in step S130. For example, reference value T1 can be set at about 1[K].

Similarly, on the discharge side of the compressor, when a temperature difference (TH−Tsh) between a saturation temperature Tsh of the refrigerant at the high-pressure side pressure detected by pressure sensor 112 and a refrigerant temperature TH detected by temperature sensor 106 becomes lower than a prescribed reference value T2[K] (when TH−Tsh<T2), that is, when the degree of superheat (SH) on the discharge side of the compressor becomes lower than a reference value T2, it can be determined as YES in step S130. The appropriate value of reference value T2 varies depending on the type of refrigerant and the compressor efficiency. Assuming that refrigerant R32 is used and the compressor efficiency is 0.7, T2 can be set at about 20[K], for example.

Furthermore, when compressor 10 is of a low-pressure shell type, the determination in step S130 can also be made using a shell surface temperature Tshell detected by temperature sensor 110. For example, when the temperature difference (Tshell−Ts1) between saturation temperature Ts1 of the refrigerant at the low-pressure side pressure and shell surface temperature Tshell becomes lower than a prescribed reference value T3[K] (when Tshell−Ts1<T3), it can be determined as YES in step S130. In response to a decrease in degree of superheat (SH) on the compressor shell, it also can be detected that the amount of refrigerant (in a liquid phase) accumulated in accumulator 108 has reached the reference level. For example, reference value T3 can be set at about 10[K].

In this way, when one or a prescribed combination (a part or all) of determinations related to the above-mentioned reference values T1[K] to T3[K] is determined as YES, it is detected that the amount of refrigerant (in a liquid phase) accumulated in accumulator 108 has reached the reference level. Then, it can be determined as YES in step S130.

While refrigerant recovery by accumulator 108 is not completed (determined as NO in S130), controller 300 continues the ACC recovery operation (S120). On the other hand, when the refrigerant recovery by accumulator 108 has been completed (determined as YES in S130), controller 300 causes the process to proceed to step S140. Then, liquid shut-off valve 101 is closed. Thereby, the ACC recovery operation is ended.

In step S150, controller 300 performs the pump down operation for causing compressor 10 to operate in the state where shut-off valve 101 is closed. The pump down operation corresponds to one example of the "second refrigerant recovery operation.

In the pump down operation, controller 300 causes indoor fan 21 to operate (preferably, with the maximum output) and causes LEV 111 to be opened (preferably, to be fully opened).

Figure 4:
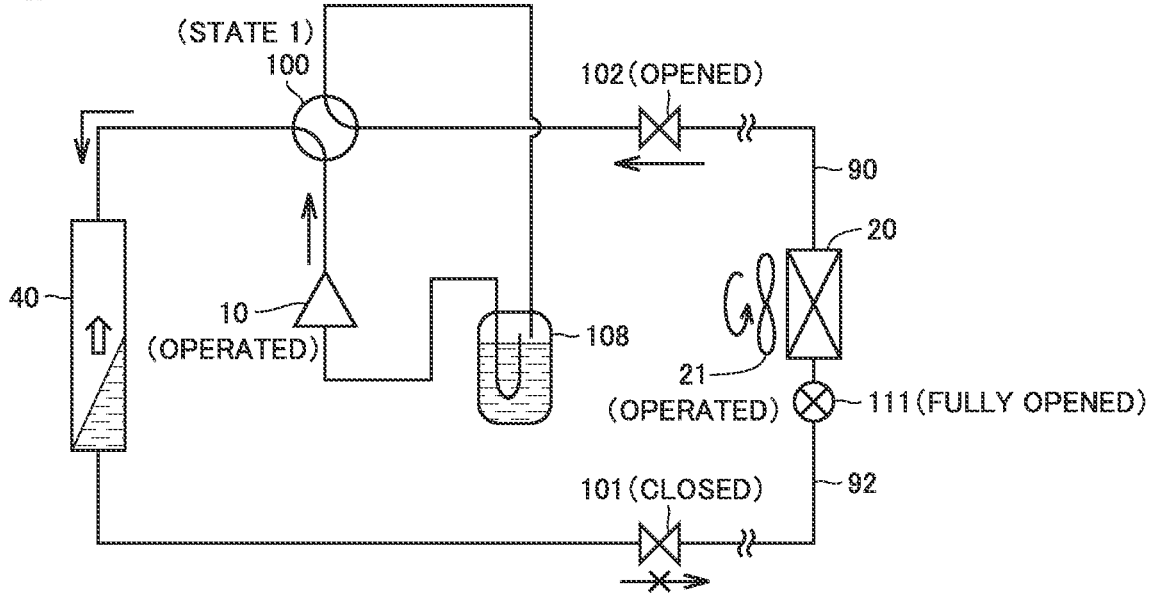
FIG. 4 is a schematic diagram for illustrating the circulation of refrigerant in the refrigeration cycle apparatus in a pump down operation.

FIG. 4 is a schematic diagram for illustrating the circulation of refrigerant in the refrigeration cycle apparatus in the pump down operation.

Referring to FIG. 4, in the pump down operation, compressor 10 is operated in the state where liquid shut-off valve 101 is closed while gas shut-off valve 102 is opened. Thereby, the refrigerant (vapor) inside indoor heat exchanger 20 and extension pipes 90 and 92 is suctioned into compressor 10 through gas shut-off valve 102 that is opened and accumulator 108. The refrigerant discharged in the high-temperature and high-pressure state from compressor 10 is fed to outdoor heat exchanger 40 and then condensed.

Since liquid shut-off valve 101 is closed, the condensed refrigerant is stored in outdoor heat exchanger 40. In this way, by the pump down operation, the refrigerant in a liquid phase is accumulated in outdoor heat exchanger 40, so that the refrigerant can be recovered in outdoor unit 2. As refrigerant recovery progresses, the low-pressure side pressure of compressor 10 (the detection value from pressure sensor 104 in FIG. 1) decreases toward the atmospheric pressure.

In the pump down operation stage after the ACC recovery operation, accumulator 108 has only a very small space in which refrigerant (in a liquid phase) can be accumulated. Thus, it is preferable to promote evaporation (vaporization) of the refrigerant in indoor heat exchanger 20 in order to avoid occurrence of the liquid-back condition in compressor 10. Accordingly, in step S130, indoor fan 21 can be operated (preferably, in the output maximum state). By promoting vaporization of the refrigerant, the rate of refrigerant recovery can also be enhanced. Furthermore, LEV 111 is opened (preferably fully opened) in order to suppress loss of the pressure for suction of the refrigerant by compressor 10.

Again referring to FIG. 2, during execution of the pump down operation (S150), controller 300 can determine in step S180 related to the remaining amount of refrigerant whether the low-pressure side pressure of compressor 10 becomes lower than the reference value or not, and additionally, can determine in step S160 whether the recovery into outdoor heat exchanger 40 has completed or not, and can also determine in step S170 whether the liquid-back condition occurs or not in compressor 10. It should be noted that determinations in steps S160 to S180 can also be modified so as to omit some of the determinations.

For example, the determination in step S160 can be made based on supercool degree efficiency $\varepsilon_{SC}$ in outdoor heat exchanger 40. Based on saturation temperature Tsh of the refrigerant at the high-pressure side pressure as described above, a refrigerant temperature Toh at the outlet of outdoor heat exchanger 40 detected by temperature sensor 107, and refrigerant temperature TH detected by temperature sensor 106 (corresponding to the refrigerant temperature at the inlet of outdoor heat exchanger 40), supercool degree efficiency $\varepsilon_{SC}$ can be calculated by the following equation (1).

$$\varepsilon_{SC}=(Tsh-Toh)/(Tsh-TH) \quad (1)$$

In other words, when supercool degree efficiency $\varepsilon_{SC}$ becomes lower than a reference value K1 ($\varepsilon_{SC}$<K1), it can be determined as YES in step S160. Alternatively, when refrigerant pressure PH on the high-pressure side detected by pressure sensor 112 (corresponding to the refrigerant pressure at the inlet of outdoor heat exchanger 40) becomes lower than a design value P1 (PH<P1), it can be determined as YES in step S160. In this way, when one or both of the determination based on supercool degree efficiency $\varepsilon_{SC}$ and the determination based on refrigerant pressure PH is or are determined as YES, it is determined that outdoor heat exchanger 40 has no more space for refrigerant recovery. Thus, it can be determined as YES in step S160.

The determination in step S170 as to whether the liquid-back condition occurs or not, that is, as to whether refrigerant in a liquid phase exists or not on the suction side of compressor 10, can be made in the same manner as with the ACC recovery completion determination in step S130. For example, the determination similar to the ACC recovery completion determination can be made using reference values T1 #[K], T2 #[K] and T3 #[K] that are set to be lower than the above-mentioned reference values T1[K], T2[K] and T3[K], respectively. Also in this case, when one or a prescribed combination (a part or all) of the determinations related to reference values T1 #[K] to T3 #[K] is determined as YES, occurrence of the liquid-back condition is detected. Thus, it can be determined as YES in step S170.

The determination in step S180 is made for determining the amount of remaining refrigerant to be suctioned from the indoor unit 3 side. When refrigerant pressure PL detected on the low-pressure side of compressor 10 by pressure sensor 104 becomes lower than the predetermined reference value set in the vicinity of the atmospheric pressure, it can be determined as YES in step S180.

When at least one of steps S160 to S180 is determined as YES, controller 300 causes the process to proceed to step S190, in which compressor 10 is stopped. Thereby, the pump down operation is ended, and the refrigerant recovery operation is also ended. On the other hand, when all of steps S160 to S180 are determined as NO, the pump down operation (S150) is continued.

As a result, in the state where the amount of refrigerant accumulated in outdoor heat exchanger 40 has reached the upper limit (determined as YES in S160), or in the state where there is no more refrigerant to be recovered (determined as YES in S180), the pump down operation can be ended. On the other hand, even in the case where refrigerant recovery is still required (determined as NO in each of S160 and S180), the operation of compressor 10 can be stopped when a liquid-back condition occurs in compressor 10 (determined as YES in S170).

Furthermore, in step S200, controller 300 outputs a control signal for closing gas shut-off valve 102 when the pump down operation is ended.

Figure 5:
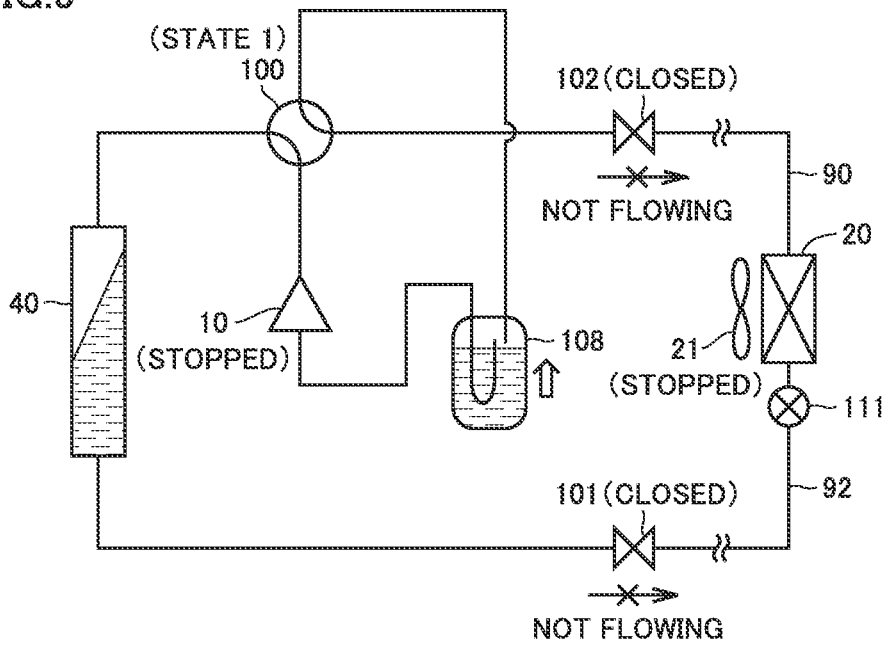
FIG. 5 is a conceptual diagram illustrating the state of the refrigerant circuit at the end of the pump down operation in the refrigeration cycle apparatus according to the first embodiment.

FIG. 5 shows a conceptual diagram illustrating the state of the refrigerant circuit at the end of the pump down operation.

Referring to FIG. 5, at the end of the pump down operation, the refrigerant in a liquid phase is accumulated in accumulator 108. Thus, gas shut-off valve 102 is closed to thereby allow interruption of the path through which the refrigerant accumulated in accumulator 108 flows backward to indoor unit 3. In this way, in refrigeration cycle apparatus 1*a* (FIG. 1), an "interruption mechanism" can be provided, in which the refrigerant path between accumulator 108 and indoor unit 3 is interrupted after the end of the refrigerant recovery operation by gas shut-off valve 102 closed by the control signal from controller 300.

As described above, according to refrigeration cycle apparatus 1*a* of the first embodiment, the amount of refrigerant to be recovered can be increased by performing the ACC recovery operation and the pump down operation in a stepwise manner upon detection of a leakage of refrigerant.

Furthermore, by appropriately controlling the operation of indoor fan 21 in each of the ACC recovery operation and the pump down operation, the amount of refrigerant to be recovered in accumulator 108 and outdoor heat exchanger 40 on the whole can be further increased.

Also, by making the determination in step S180 during the pump down operation after the ACC recovery operation, it can be appropriately determined whether the compressor can be stopped or not in accordance with the amount of remaining refrigerant to be recovered on the indoor unit 3 side. Furthermore, by making the determination in step S170 to monitor occurrence of the liquid-back condition in compressor 10, compressor 10 can be protected in refrigeration cycle apparatus 1*a* of the present embodiment in which the refrigerant in a liquid phase is actively accumulated in accumulator 108.

Furthermore, at the end of the pump down operation, gas shut-off valve 102 is closed to interrupt the refrigerant path between accumulator 108 and indoor unit 3. Thereby, the refrigerant recovered in outdoor unit 2 can be prevented from flowing backward to indoor unit 3.

In the example in FIG. 1, each of shut-off valves 101 and 102 is an automatic valve that can be opened and closed by controller 300, but shut-off valve 102 may also be able to be a manual valve that is opened and closed by user's operation.

When gas shut-off valve 102 is a manual valve, the process in step S200 (FIG. 2) at the end of the pump down operation can be changed so as to output a guidance to a user for urging the user to close gas shut-off valve 102.

Modification of First Embodiment

Figure 6:
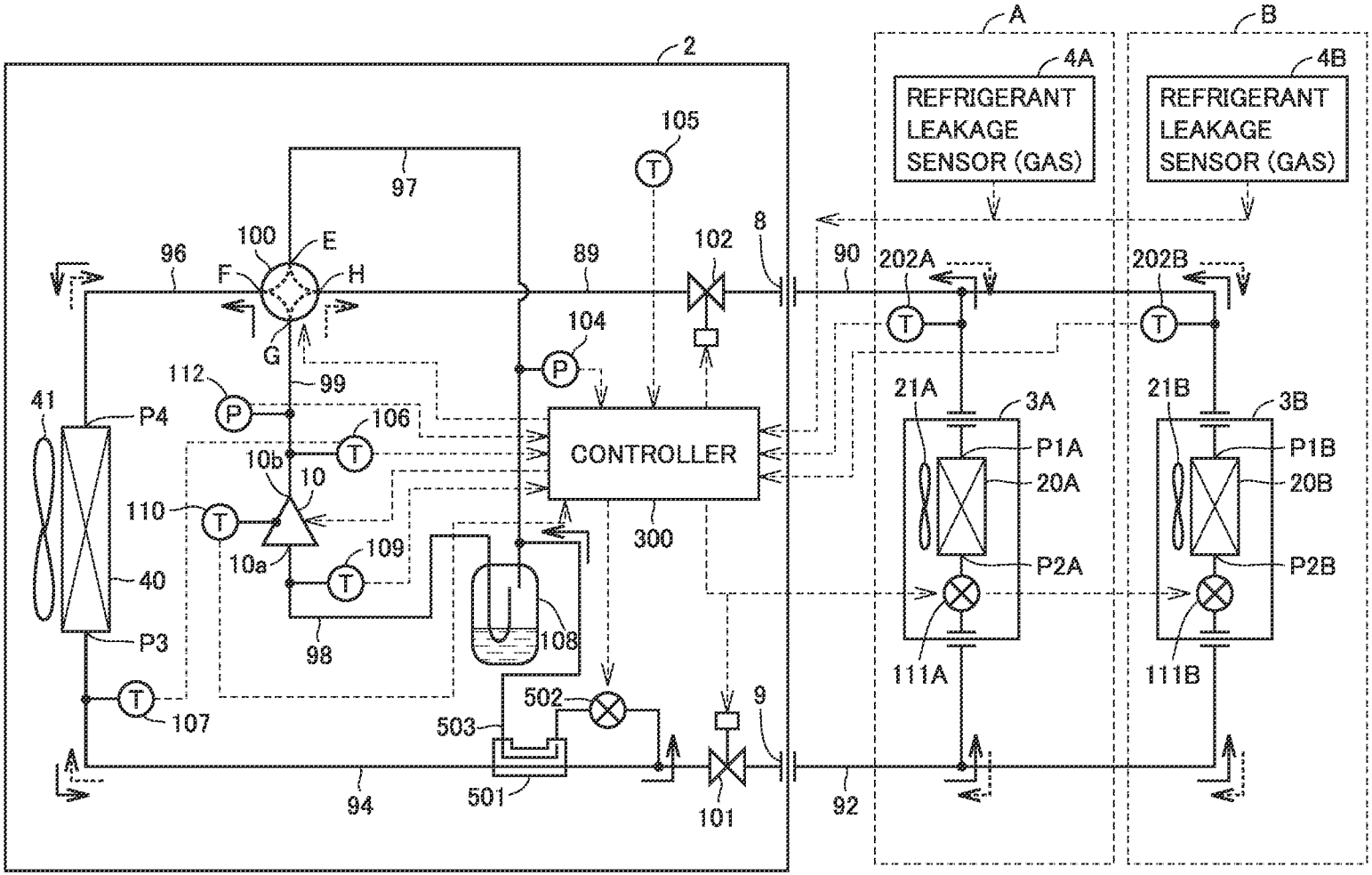
FIG. 6 is a block diagram showing the configuration of a refrigerant circuit in a refrigeration cycle apparatus according to a modification of the first embodiment.

FIG. 6 is a block diagram showing the configuration of a refrigerant circuit in a refrigeration cycle apparatus according to a modification of the first embodiment.

When comparing FIG. 6 with FIG. 1, a refrigeration cycle apparatus 1*b* according to the modification of the first embodiment is different from refrigeration cycle apparatus 1*a* shown in FIG. 1 in that it further includes an inside heat exchanger 501, an expansion valve 502, and a bypass pipe 503. Since other configurations in refrigeration cycle apparatus 1*b* are the same as those in refrigeration cycle apparatus 1*a* (FIG. 1), the detailed description thereof will not be repeated.

Bypass pipe 503 is disposed in the refrigerant circuit so as to route refrigerant to the refrigerant inlet of accumulator 108 from the refrigerant path (pipe 94) that connects outdoor heat exchanger 40 and each of expansion valves 111A and 111B. Expansion valve 502 is provided at some midpoint in bypass pipe 503.

Inside heat exchanger 501 is provided between outdoor heat exchanger 40 and each of expansion valves 111A and 111B in the refrigerant circuit and configured to perform heat exchange between the refrigerant flowing through bypass pipe 503 and the refrigerant flowing through pipe 94.

As expansion valve 502, a linear electronic expansion valve (LEV) is representatively applied, which has a degree of opening that is electronically controlled according to the command from controller 300.

Expansion valve 502 is opened (degree of opening>0) to thereby form a bypass path for refrigerant that extends through inside heat exchanger 501 to accumulator 108. Also, by changing the degree of opening, the amount of refrigerant that passes through the bypass path can be adjusted.

On the other hand, by closing expansion valve 502 (degree of opening=0: fully closed), the bypass path for refrigerant that extends through bypass pipe 503 can be interrupted. In other words, expansion valve 502 corresponds to one example of the "control valve" in the "bypass path".

During the operation of refrigeration cycle apparatus 1*b*, formation of a bypass path leads to heat exchange in inside heat exchanger 501, so that liquefaction of the refrigerant that flows through pipe 94 can be promoted. Thereby, refrigerant noise can be suppressed while pressure loss can be suppressed.

Also in refrigeration cycle apparatus 1*b* according to the modification of the first embodiment, the refrigerant recovery operation having been described with reference to FIG. 2 can be applied. Also, by combining the pump down operation utilizing a bypass path as shown in FIG. 7, the amount of refrigerant to be recovered can be further increased.

Figure 7:
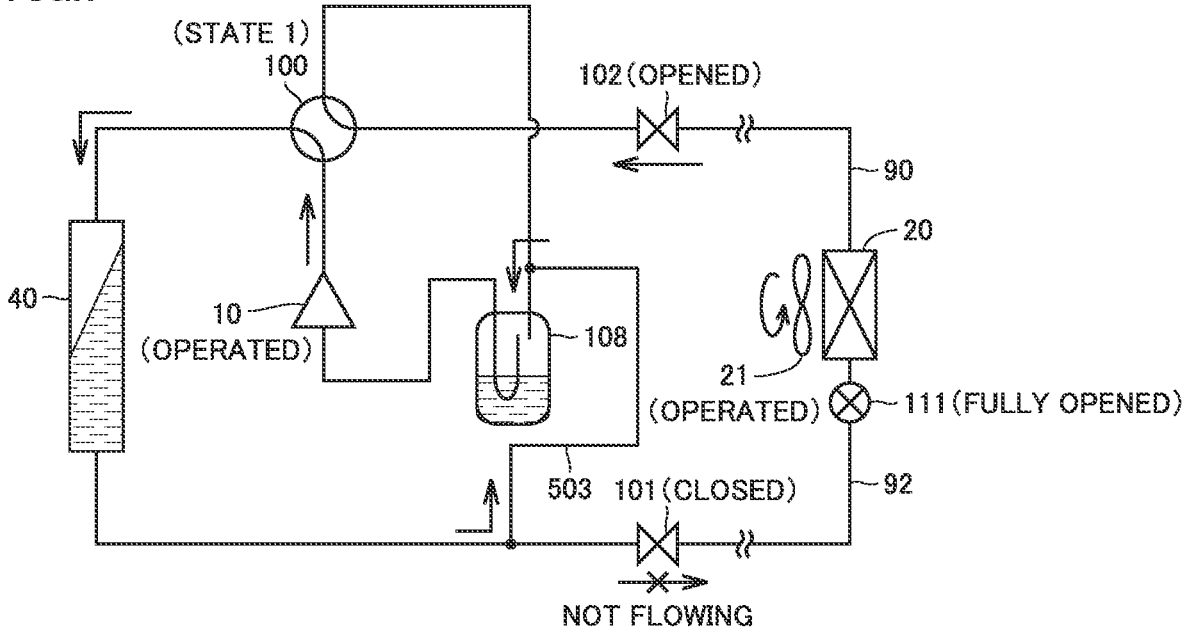
FIG. 7 is a conceptual diagram illustrating a pump down operation in the state where a bypass path is formed in the refrigeration cycle apparatus according to the modification of the first embodiment.

FIG. 7 is a conceptual diagram illustrating the pump down operation in the state where a bypass path is formed in the refrigeration cycle apparatus according to the modification of the first embodiment.

Referring to FIG. 7, when compressor 10 is operated in the state where liquid shut-off valve 101 is closed while gas shut-off valve 102 is opened and in the state where the bypass path is formed by opening expansion valve 502 (FIG. 6), a refrigerant path can be formed, through which the refrigerant suctioned from the indoor unit 3 side is introduced into accumulator 108 while being in a liquid phase, and then, the refrigerant is accumulated therein. In the following, the pump down operation in FIG. 8 will be also referred to as the "second mode".

On the other hand, in the pump down operation performed in the state where expansion valve 502 (FIG. 6) is closed to interrupt the bypass path, the same refrigerant path as that in FIG. 4 is formed, thereby allowing formation of a refrigerant path through which the refrigerant suctioned from the indoor unit 3 side is accumulated in outdoor heat exchanger 40 while being in a liquid phase, and then, the refrigerant is accumulated therein. In the following, the pump down operation in the state where the bypass path is interrupted will also be referred to as the "first mode".

As having been described in the first embodiment, the pump down operation is started after accumulator 108 has no more space for refrigerant recovery due to the ACC recovery operation. However, in the pump down operation in the first mode, the refrigerant accumulated in accumulator 108 may move to outdoor heat exchanger 40 during accumulation of the refrigerant in outdoor heat exchanger 40. Accordingly, even when recovery in outdoor heat exchanger 40 is completed during the pump down operation in the first mode (S160 in FIG. 2), accumulator 108 may have some space again for refrigerant recovery at this point of time.

Figure 8:
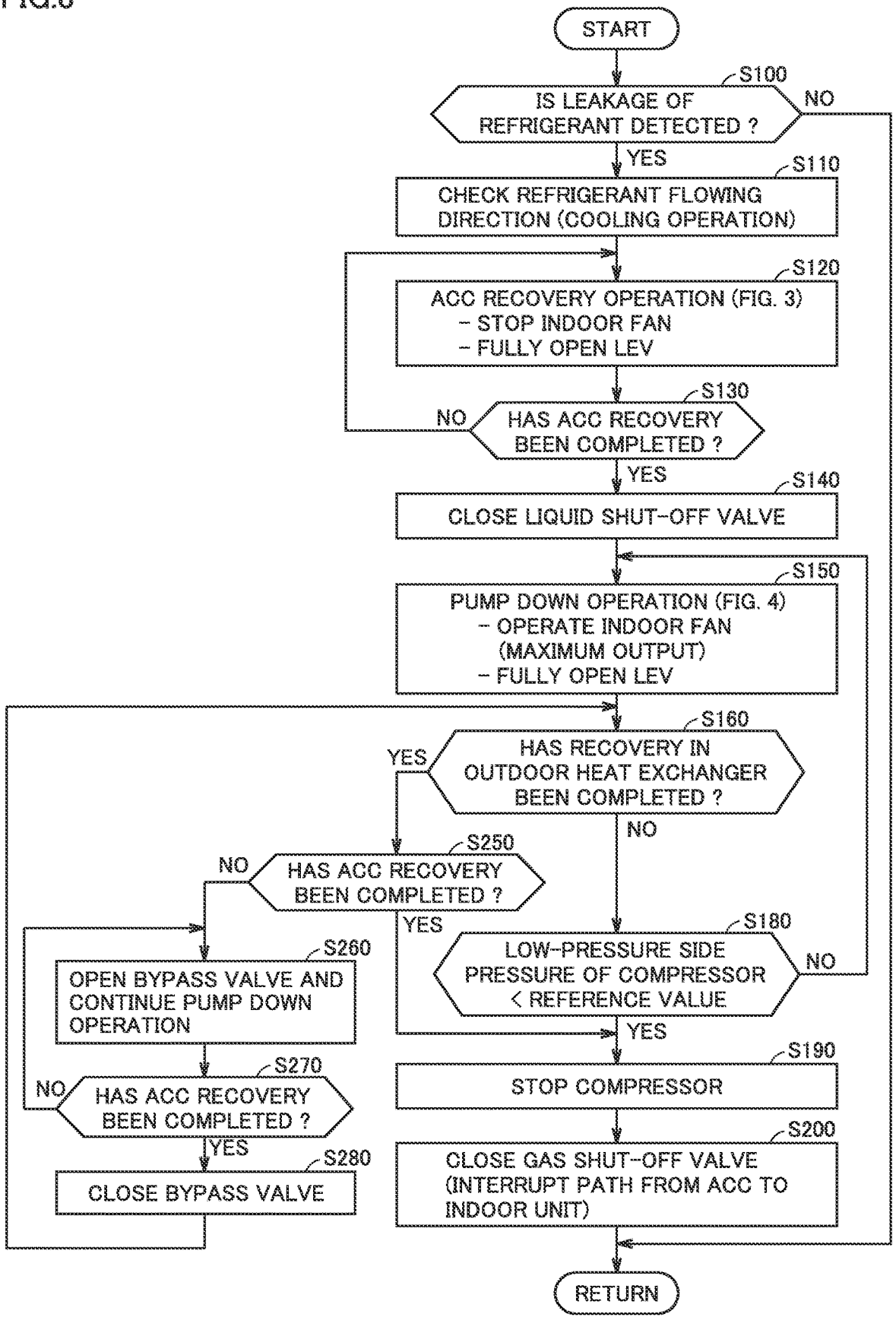
FIG. 8 is a flowchart illustrating a control process in a refrigerant recovery operation in the refrigeration cycle apparatus according to the modification of the first embodiment.

In such a case, the refrigerant can be accumulated again in accumulator 108 by combining the pump down operation in the second mode shown in FIG. 8.

FIG. 8 is a flowchart illustrating a control process in the refrigerant recovery operation in the refrigeration cycle apparatus according to the modification of the first embodiment.

Referring to FIG. 8, in the same steps S110 to S150 as those in FIG. 2, upon detection of a leakage of refrigerant, controller 300 ends the ACC recovery operation (S120), and thereafter, closes liquid shut-off valve 101, and then starts the pump down operation (S150). In refrigeration cycle apparatus 1*b*, the pump down operation can include: the first mode in which the bypass path is interrupted; and the second mode in which the bypass path is formed.

In the pump down operation in step S150, controller 300 performs the same pump down operation as that in the first embodiment in the state where expansion valve 502 is closed, that is, in the state where the bypass path is interrupted (the first mode). Furthermore, in the pump down operation in the first mode, it is determined in the same step S160 as that in FIG. 1 whether recovery into outdoor heat exchanger 40 has been completed or not. When outdoor heat exchanger 40 has no more space in which the refrigerant can be accumulated, it is determined as YES in step S160. Then, the process proceeds to step S250.

In step S250, controller 300 determines whether accumulator 108 has a space or not for refrigerant recovery at that point of time. For example, in step S250, the determination can be made based on the detection result from a liquid level sensor (not shown) disposed inside accumulator 108, as in step S130. Alternatively, the determination in step S250 can also be made based on the decrease in degree of superheat (SH) on the suction side, on the discharge side, and on the shell of the compressor using reference values T1 to T3 as described above.

When movement of the refrigerant during the pump down operation in the first mode produces a space in accumulator 108 for refrigerant recovery (determined as NO in S250), controller 300 causes the process to proceed to step S260. In step S260, in the state where expansion valve 502 (bypass valve) is opened to form a bypass path, the operation of compressor 10 is continued, so that the pump down operation (the second mode) is performed.

During the pump down operation in the second mode (S260), controller 300 determines in step S270 whether accumulator 108 has a space or not for refrigerant recovery. The determination in step S270 can be made in the same manner as in step S250. When accumulator 108 has a space for refrigerant recovery (determined as NO in S270), the pump down operation (in the second mode) in step S260 is continued.

On the other hand, when accumulator 108 has no more space for refrigerant recovery due to the pump down operation in step S260 (determined as YES in S270), controller 300 causes the process to proceed to step S280. In step S280, expansion valve 502 (bypass valve) is closed to thereby interrupt the bypass path.

Furthermore, controller 300 returns the process to step S160 and again determines whether outdoor heat exchanger 40 still has a space or not for refrigerant recovery at that point of time. Then, when outdoor heat exchanger 40 still has a space for refrigerant recovery (determined as NO in S160), the process proceeds to step S180. Then, when the low-pressure side pressure of compressor 10 is higher than a reference value (determined as NO in S180), the process is returned to step S150. Thereby, the refrigerant can be recovered in outdoor heat exchanger 40 by the pump down operation in the first mode.

When not only accumulator 108 but also outdoor heat exchanger 40 has no space for refrigerant recovery at the end of the pump down operation in the second mode, each of steps S250 and S160 is determined as YES. Thus, in step S190, compressor 10 is stopped to thereby end the pump down operation. Furthermore, gas shut-off valve 102 is closed in the same step S200 as that in FIG. 2.

In this way, by executing the pump down operation in which the bypass path is interrupted (in the first mode) and the pump down operation in which the bypass path is formed (in the second mode), the amount of refrigerant to be recovered can be ensured even when the refrigerant moves between accumulator 108 and outdoor heat exchanger 40 during the pump down operation.

Thereby, the pump down operation can be performed until the low-pressure side pressure of compressor 10 decreases because no refrigerant to be recovered remains on the indoor unit 3 side (determined as YES in S180), or until each of accumulator 108 and outdoor heat exchanger 40 has no more space for refrigerant recovery.

In order to prevent the pump down operation from being lengthened in time due to a large number of times of repetition of the first mode and the second mode, the pump down operation may be forcibly ended by causing the process to proceed directly to step 190 when a prescribed time period has elapsed since the pump down operation was started in the first mode in response to the end of the ACC recovery operation, or when the first mode and the second mode have been repeated a prescribed number of times.

In this way, in the refrigeration cycle apparatus according to the modification of the first embodiment, by further executing the pump down operation in the state where a bypass path is formed, it becomes possible to increase the amount of refrigerant to be accumulated in accumulator 108 and outdoor heat exchanger 40 at the end of the pump down operation. As a result, the amount of refrigerant recovered by the refrigerant recovery operation upon detection of refrigerant leakage can be further increased.

Second Embodiment

The second embodiment and its modification will be described with regard to control performed at the end of the pump down operation in the configuration in which gas shut-off valve 102 does not need to be disposed.

Figure 9:
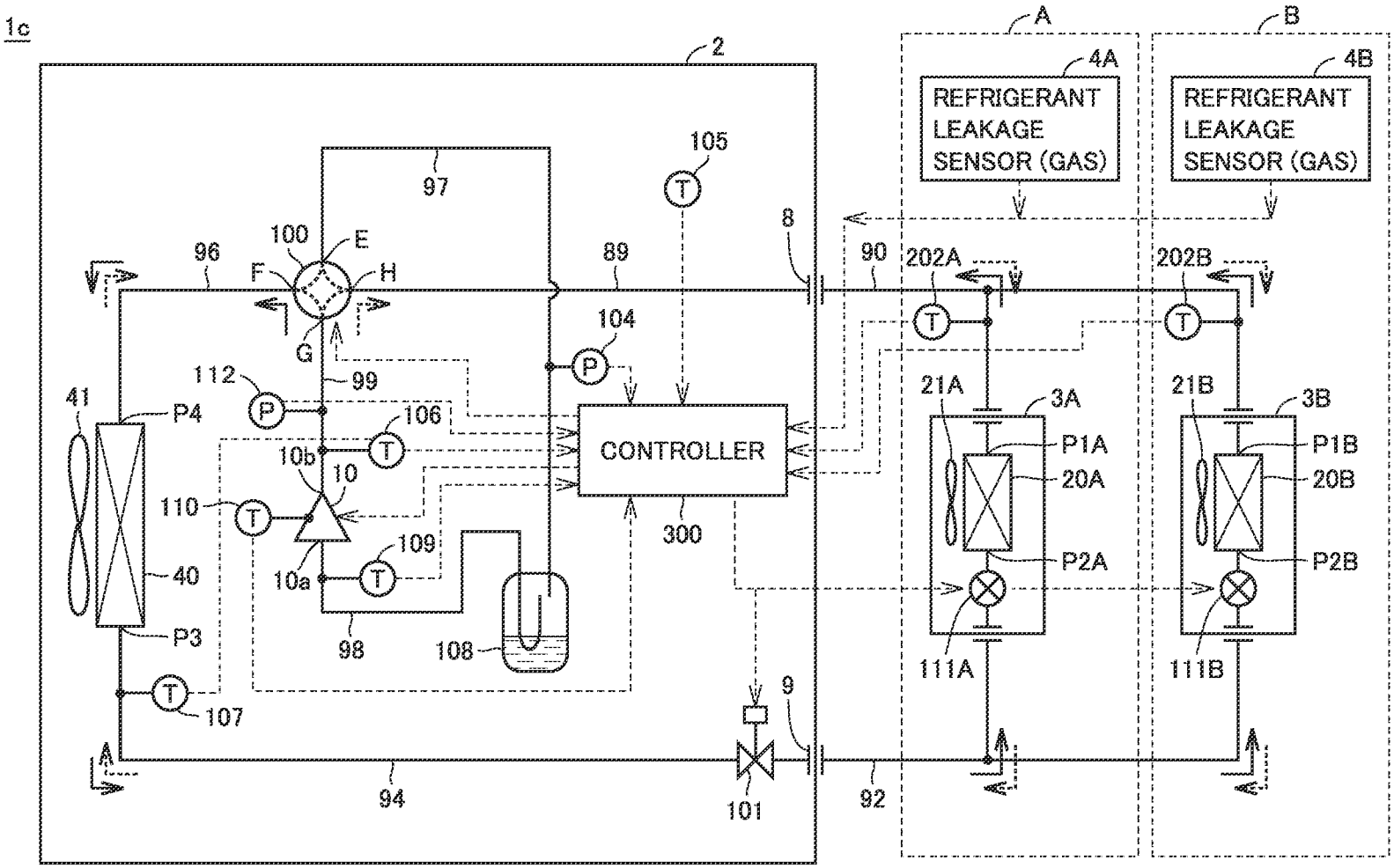
FIG. 9 is a block diagram illustrating the configuration of a refrigeration cycle apparatus according to the second embodiment.

FIG. 9 is a block diagram illustrating the configuration of a refrigeration cycle apparatus 1*c* according to the second embodiment.

When comparing FIG. 9 with FIG. 1, refrigeration cycle apparatus 1*c* according to the second embodiment is different from refrigeration cycle apparatus 1*a* (FIG. 1) in that gas shut-off valve 102 is not disposed. Since other configurations in refrigeration cycle apparatus 1*c* are the same as those in refrigeration cycle apparatus 1*a* (FIG. 1), the detailed description thereof will not be repeated.

Figure 10:
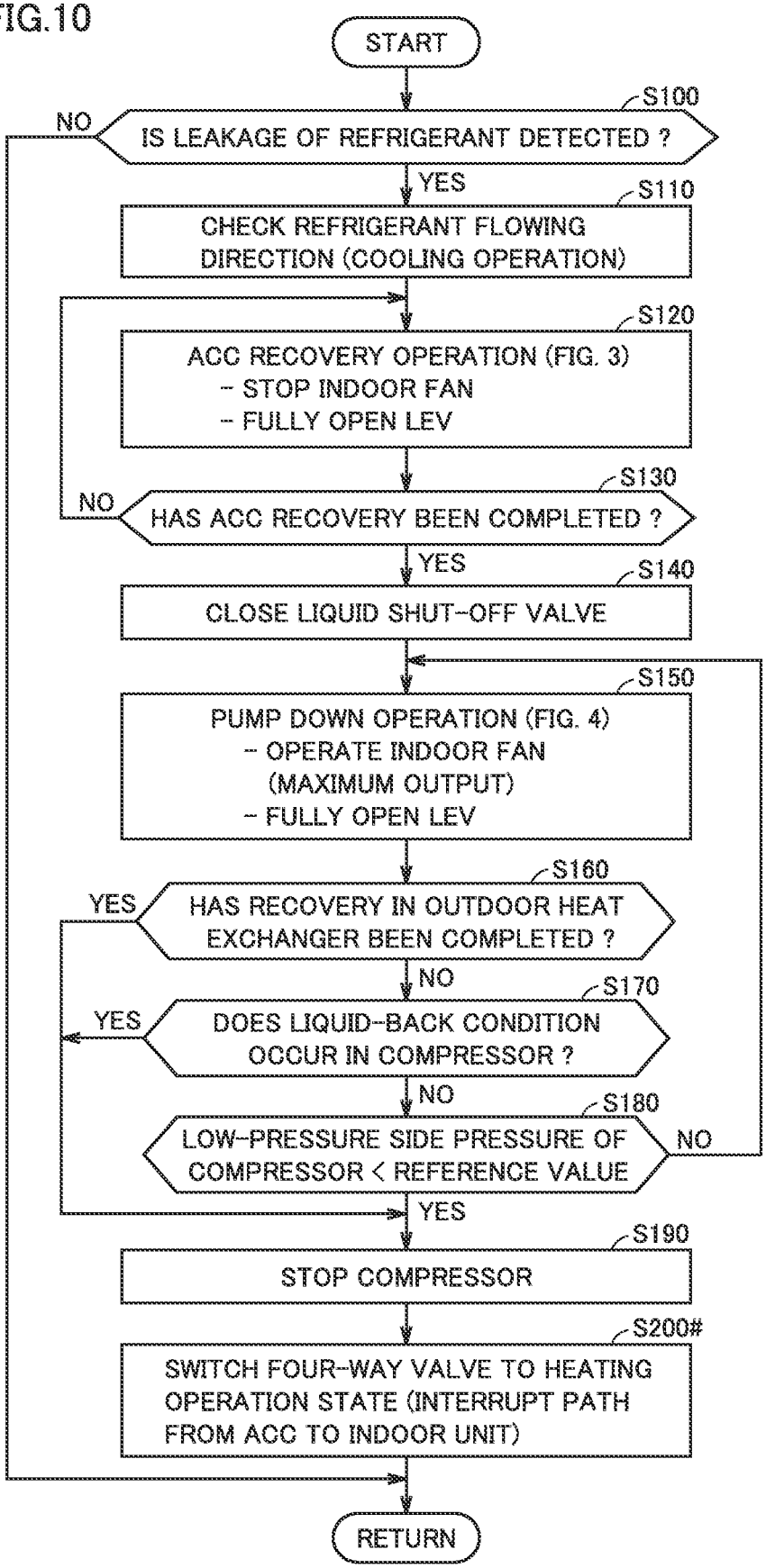
FIG. 10 is a flowchart illustrating a control process in a refrigerant recovery operation in the refrigeration cycle apparatus according to the second embodiment.

FIG. 10 is a flowchart illustrating a control process in the refrigerant recovery operation in refrigeration cycle apparatus 1*c* according to the second embodiment.

Referring to FIG. 10, since the process of steps S100 to S190 in the refrigerant recovery operation in refrigeration cycle apparatus 1*c* according to the second embodiment is the same as that in the first embodiment (FIG. 2), with the exception that the control of gas shut-off valve 102 is not performed in the second embodiment, the description thereof will not be repeated.

In refrigeration cycle apparatus 1*c* according to the second embodiment, when the pump down operation is ended, controller 300 stops compressor 10 (S190), and thereafter, performs step S200 #. In step S200 #, controller 300 generates a control signal for switching four-way valve 100 from state 1 (the cooling operation state) to the heating operation state (state 2).

Figure 11:
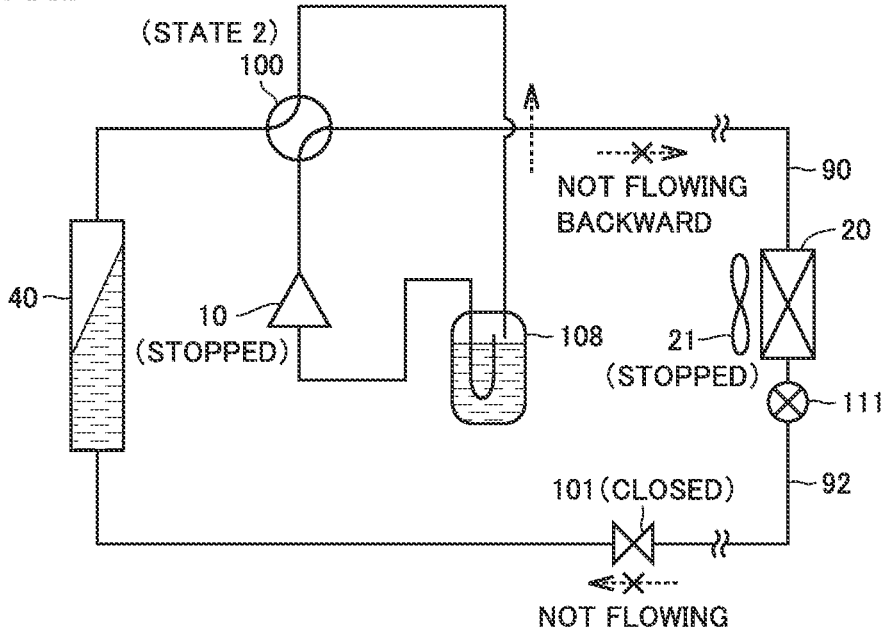
FIG. 11 is a conceptual diagram illustrating the state of a refrigerant circuit at the end of a pump down operation in the refrigeration cycle apparatus according to the second embodiment.

FIG. 11 is a conceptual diagram for illustrating the state at the end of the refrigerant recovery operation in the refrigeration cycle apparatus according to the second embodiment.

Referring to FIG. 11, when four-way valve 100 is controlled to bring about state 2 (the heating operation state), accumulator 108 is connected to outdoor heat exchanger 40. Accumulator 108 is to be connected to indoor unit 3 through compressor 10 that is being stopped. Thus, the refrigerant accumulated in accumulator 108 can be prevented from flowing backward to indoor unit 3. In other words, four-way valve 100 controlled to bring about state 2 (the heating operation state) can provide an "interruption mechanism" for interrupting the refrigerant path between accumulator 108 and indoor unit 3 after the end of the refrigerant recovery operation.

In this way, according to refrigeration cycle apparatus 1*c* in the second embodiment, the refrigerant recovery operation in the first embodiment can be performed even though gas shut-off valve 102 is not disposed, and also, the path through which the refrigerant recovered in outdoor unit 2 flows backward to indoor unit 3 can be interrupted at the end of the pump down operation.

The refrigerant recovery operation (FIG. 10) according to the second embodiment can also be applicable to the configuration in which a manual valve is applied as gas shut-off valve 102 in refrigeration cycle apparatus 1*a* (FIG. 1) in the first embodiment.

Also in refrigeration cycle apparatus 1*b* of the modification of the first embodiment, the refrigerant recovery operation according to the second embodiment is applicable by replacing step S200 with step S200 # (FIG. 10) in the control process in FIG. 8. In this case, in the configuration of refrigeration cycle apparatus 1*b* in FIG. 6, gas shut-off valve 102 (automatic valve) does not have to be disposed, or gas shut-off valve 102 can be provided as a manual valve.

Modification of Second Embodiment

Figure 12:
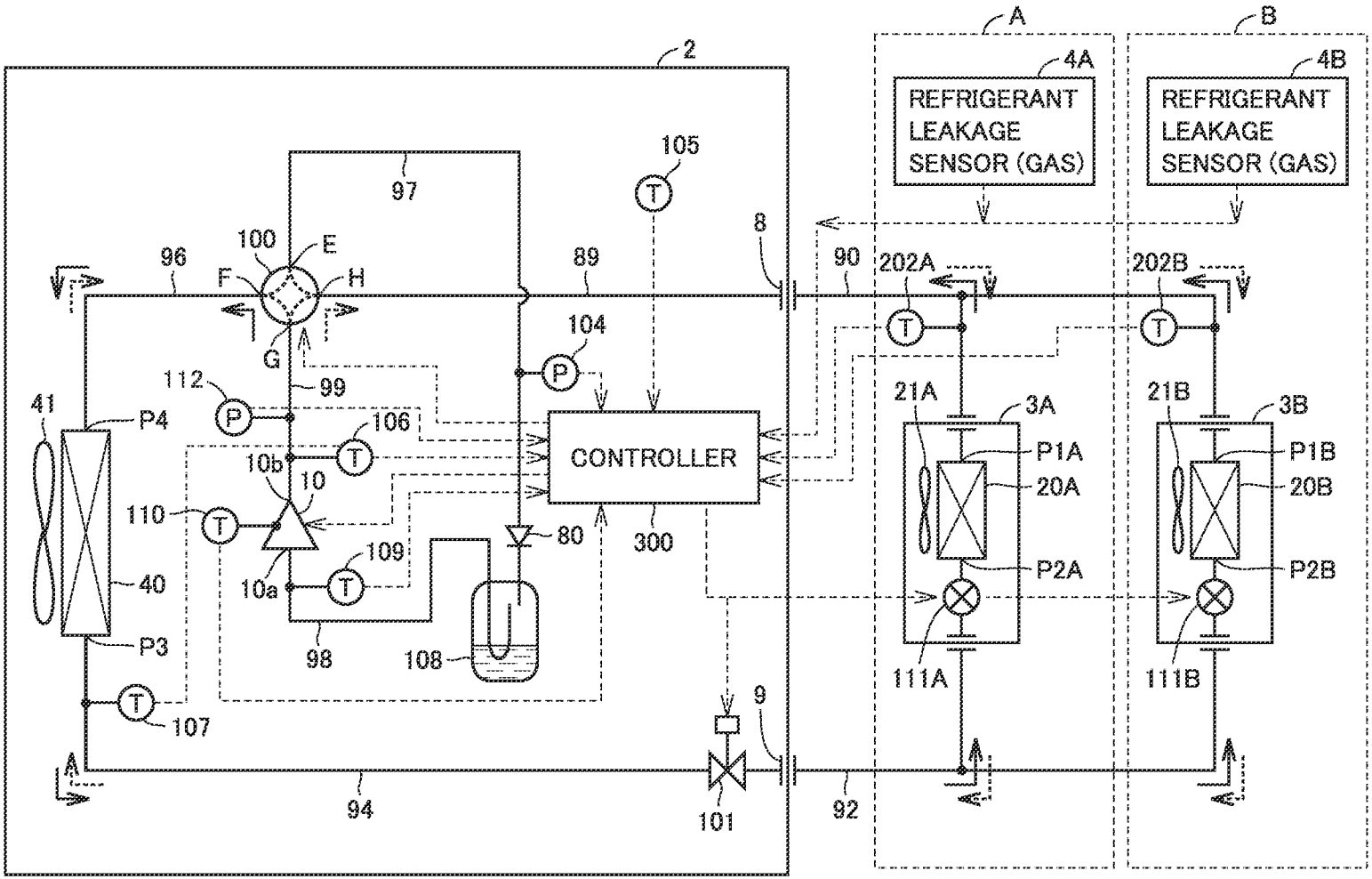
FIG. 12 is a block diagram illustrating the configuration of a refrigeration cycle apparatus according to a modification of the second embodiment.

FIG. 12 is a block diagram illustrating the configuration of a refrigeration cycle apparatus according to a modification of the second embodiment.

When comparing FIG. 12 with FIG. 1, a refrigeration cycle apparatus 1*d* according to the modification of the second embodiment is different from refrigeration cycle apparatus 1*a* (FIG. 1) in that gas shut-off valve 102 is not disposed.

Furthermore, a check valve 80 is connected between port E of four-way valve 100 and the refrigerant suction side of accumulator 108. Check valve 80 is connected in the direction in which the refrigerant is allowed to flow from four-way valve 100 (port E) toward accumulator 108 and in which the refrigerant is prevented from flowing from accumulator 108 toward four-way valve 100 (port E). Since other configurations in refrigeration cycle apparatus 1*d* are the same as those in refrigeration cycle apparatus 1*a* (FIG. 1), the detailed description thereof will not be repeated.

Figure 13:
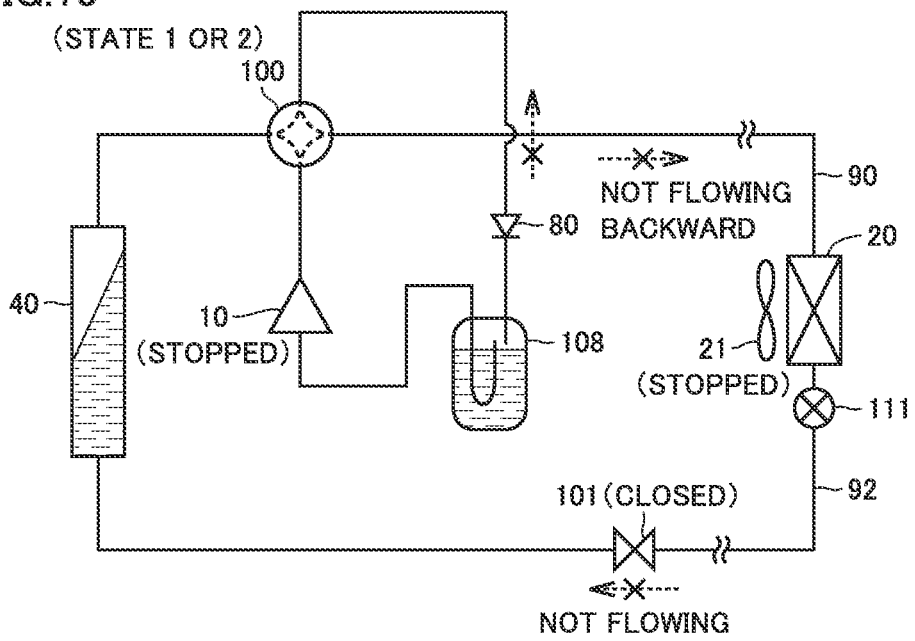
FIG. 13 is a conceptual diagram illustrating the state of a refrigerant circuit at the end of a pump down operation in the refrigeration cycle apparatus according to the modification of the second embodiment.

FIG. 13 is a conceptual diagram illustrating the state of a refrigerant circuit at the end of the pump down operation in the refrigeration cycle apparatus according to the modification of the second embodiment.

Referring to FIG. 13, check valve 80 is disposed to thereby allow interruption of the refrigerant path from accumulator 108 to indoor unit 3 after compressor 10 is stopped even when four-way valve 100 is in state 1 (the cooling operation state) and even when port E connected to accumulator 108 is in communication with port H connected to pipe 89 leading to indoor unit 3.

Also, when four-way valve 100 is in state 2 (the heating operation state), accumulator 108 is connected to indoor unit 3 through compressor 10 that is being stopped, as having been described with reference to FIG. 9. Thus, the refrigerant path from accumulator 108 to indoor unit 3 is interrupted.

Accordingly, check valve 80 is disposed to thereby allow formation of an "interruption mechanism" for interrupting the refrigerant path between accumulator 108 and indoor unit 3 after the end of the refrigerant recovery operation irrespective of the state of four-way valve 100.

Thus, according to refrigeration cycle apparatus 1*d* of the modification of the second embodiment, even when gas shut-off valve 102 is not disposed, but when check valve 80 is disposed, the path through which the refrigerant recovered in outdoor unit 2 flows backward to indoor unit 3 can be interrupted at the end of the refrigerant recovery operation in the first embodiment.

In addition, check valve 80 can be disposed at the same position as that in FIG. 11 also in refrigeration cycle apparatus 1*b* (FIG. 6) according to the modification of the first embodiment. In this case, the process in step S200 can be omitted in the control process in FIG. 8.

The present embodiment has been described with regard to the refrigeration cycle apparatus that allows switching by four-way valve 100 between the cooling operation state and the heating operation state. In contrast, the refrigerant recovery operation according to the first embodiment is also applicable to a refrigeration cycle apparatus only for a cooling operation.

Furthermore, an on-off valve (representatively, a solenoid valve) that is automatically controlled has been exemplified as shut-off valve 101. However, also when an electronic control valve capable of automatically variably controlling the degree of opening is disposed in place of the on-off valve, the function of the "first shut-off valve" can be implemented by controlling the electronic control valve to be fully closed.

For the purpose of clarification, it has been initially intended at the time of filing of the present application to appropriately combine the configurations described in a plurality of embodiments described above, including any combination not mentioned in the specification, within a range free of inconsistency or contradiction.

It should be understood that the embodiments disclosed herein are illustrative and non-restrictive in every respect. The scope of the present invention is defined by the terms of the claims, rather than the description above, and is intended to include any modifications within the meaning and scope equivalent to the terms of the claims.

The invention claimed is:

1. A refrigeration cycle apparatus equipped with an outdoor unit and at least one indoor unit, the refrigeration cycle apparatus comprising:

a compressor;

an accumulator provided on a suction side for refrigerant relative to the compressor;

an outdoor heat exchanger provided in the outdoor unit;

an indoor heat exchanger provided in the indoor unit;

an expansion valve;

an indoor fan provided corresponding to the indoor heat exchanger;

a leakage sensor for detecting a refrigerant leak;

a first pressure detector disposed on a refrigerant inlet side of the compressor;

a second pressure detector disposed on a refrigerant outlet side of the compressor;

a first temperature detector disposed on the refrigerant inlet side of the compressor;

a second temperature detector disposed on the refrigerant outlet side of the compressor;

a circulation path for the refrigerant, the circulation path being located in the outdoor unit and the indoor unit to include the compressor, the accumulator, the expansion valve, the outdoor heat exchanger, and the indoor heat exchanger;

a first shut-off valve provided in a path that connects the outdoor heat exchanger and the indoor heat exchanger without passing through the compressor in the circulation path; and a controller configured to control an operation of the refrigeration cycle apparatus, wherein when the leakage sensor detects a leakage of the refrigerant, a first refrigerant recovery operation and a second refrigerant recovery operation are performed in a state where the circulation path is formed in a direction in which the refrigerant discharged from the compressor passes through the outdoor heat exchanger and the expansion valve, and subsequently passes through the indoor heat exchanger, in the first refrigerant recovery operation, the compressor is operated while the first shut-off valve and the expansion valve are opened, in the second refrigerant recovery operation performed after the first refrigerant recovery operation is ended, the compressor is operated while the first shut-off valve is closed, the indoor fan is stopped in the first refrigerant recovery operation and operated in the second refrigerant recovery operation, and the second refrigerant recovery operation is ended when the controller determines that a pressure measured by the second pressure detector is lower than a first prescribed determination value.

2. The refrigeration cycle apparatus according to claim 1, further comprising an interruption valve for interrupting a path of the refrigerant between the indoor unit and the accumulator after the compressor is stopped to end the second refrigerant recovery operation.

3. The refrigeration cycle apparatus according to claim 2, wherein the interruption valve is a second shut-off valve that is closed, and the second shut-off valve is provided inside a path that connects the outdoor heat exchanger and the indoor heat exchanger through the compressor in the circulation path.

4. The refrigeration cycle apparatus according to claim 2, wherein the interruption valve is a four-way valve that is controlled to allow communication between a first port and a second port and to allow communication between a third port and a fourth port, the first port of the four-way valve is connected to a path leading to the accumulator, the second port of the four-way valve is connected to a path leading to the outdoor heat exchanger, the third port of the four-way valve is connected to a discharge side of the refrigerant relative to the compressor, the fourth port of the four-way valve is connected to a path leading to the indoor heat exchanger, and in the first refrigerant recovery operation and the second refrigerant recovery operation, the four-way valve is controlled to allow communication between the first port and the fourth port and to allow communication between the second port and the third port.

5. The refrigeration cycle apparatus according to claim 2, further comprising a four-way valve having a first port, a second port, a third port, and a fourth port, wherein the four-way valve is controlled to bring about one of:

a first state allowing communication between the first port and the fourth port and allowing communication between the second port and the third port; and a second state allowing communication between the first port and the second port and allowing communication between the third port and the fourth port, the first port of the four-way valve is connected to a path leading to the accumulator, the second port of the four-way valve is connected to a path leading to the outdoor heat exchanger, the third port of the four-way valve is connected to a discharge side of the refrigerant relative to the compressor, the fourth port of the four-way valve is connected to a path leading to the indoor heat exchanger, in the first refrigerant recovery operation and the second refrigerant recovery operation, the four-way valve is controlled to bring about the first state, the interruption valve is a check valve connected to a path between the first port and the accumulator, and the check valve is connected in a direction in which the refrigerant is allowed to flow from the first port to the accumulator and the refrigerant is prevented from flowing from the accumulator to the first port.

6. The refrigeration cycle apparatus according to claim 1, wherein the controller determines that refrigerant in a liquid phase exists on the refrigerant inlet side of the compressor based on a temperature measurement from at least one of the first temperature detector and the second temperature detector.

7. The refrigeration cycle apparatus of claim 1, wherein the second refrigerant recovery operation is ended when the controller determines that a pressure measured by the first pressure detector is lower than a second prescribed determination value.

* * * * *